US006357747B1

(12) United States Patent
Kao

(10) Patent No.: US 6,357,747 B1
(45) Date of Patent: Mar. 19, 2002

(54) EIGHTEEN-PIECE PRO-TANGRAM TILING PUZZLES

(76) Inventor: Wen-Shan Kao, 8F-8, No. 36, Heng Yang Road, Taipei (TW)

( * ) Notice: Subject to any disclaimer, the term of this patent is extended or adjusted under 35 U.S.C. 154(b) by 0 days.

(21) Appl. No.: 09/722,274

(22) Filed: Nov. 28, 2000

(51) Int. Cl.[7] ..... A63F 9/10
(52) U.S. Cl. ..... 273/157 R
(58) Field of Search ..... 273/157 R, 156, 273/153 R, 160

(56) References Cited

U.S. PATENT DOCUMENTS 1,630,530 A * 5/1927 Fryer ..... 273/157 R
3,178,186 A * 4/1965 Lee ..... 273/157 R
4,561,097 A * 12/1985 Siegel ..... 273/157 R
4,974,849 A * 12/1990 Kasuya et al. ..... 273/157 R
5,746,430 A * 5/1998 Chester ..... 273/157 R

* cited by examiner

*Primary Examiner*—Steven Wong
(74) *Attorney, Agent, or Firm*—Rabin & Berdo, P.C.

(57) ABSTRACT

An eighteen-piece pro-tangram tiling game is composed of a board and eighteen pieces of various shapes tangrams while each piece of tangrams constituted by a plurality of isosceles right triangles. The board has a square surface whose length of each side is 6 times of that of one side of the above-mentioned isosceles right triangles. These eighteen pieces of tangrams are named after its shapes, such as A-shaped piece, B-shaped piece, C-shaped piece, D-shaped piece, F-shaped piece, G-shaped piece, H-shaped piece, I-shaped piece, J-shaped piece, K-shaped piece, M-shaped piece, Q-shaped piece, R-shaped piece, S-shaped piece, V-shaped piece, W-shaped piece, X-shaped piece, Z-shaped piece for the sake of easy memorizing solutions of puzzles. By the combination of the eighteen pieces of puzzles on the board, different shapes are formed with various kinds of solutions that are great fun and good for thinking.

5 Claims, 17 Drawing Sheets

X=3

X=4

EIGHTEEN-PIECE PRO-TANGRAM TILING PUZZLES

BACKGROUND OF THE INVENTION

1. Field of the Invention

The invention related generally to tangram puzzles, and more particularly to a eighteen-piece tangram game containing polyforms obtaining by combining different units isosceles right triangles.

2. Description of the Prior Art

The conventional puzzles such as tangram or pentominoes are constituted by different numbers of geometric pieces derived from a triangle or square unit. These squares compose different shapes of puzzle pieces such as rectangles, L-shape, cross, square, Z-shape, steps, T-shape, and so on. By snugly combination of different shapes of small squares into large tetragons or rectangles, users can feel much more fun and joy of thinking.

However, the puzzles of square pieces is easier to find out more solutions during short time, players would soon have become bored with them. Also puzzles whose basic unit is square are historical games, people lose interest of such kind of games.

SUMMARY OF THE INVENTION

It is therefore the primary object of the invention is to provide an eighteen-piece pro-tangram tiling game that is composed of (made up of, form by) a plurality of isosceles right triangles for inspiring the mind of players and bringing pleasure to the wide range of individuals.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
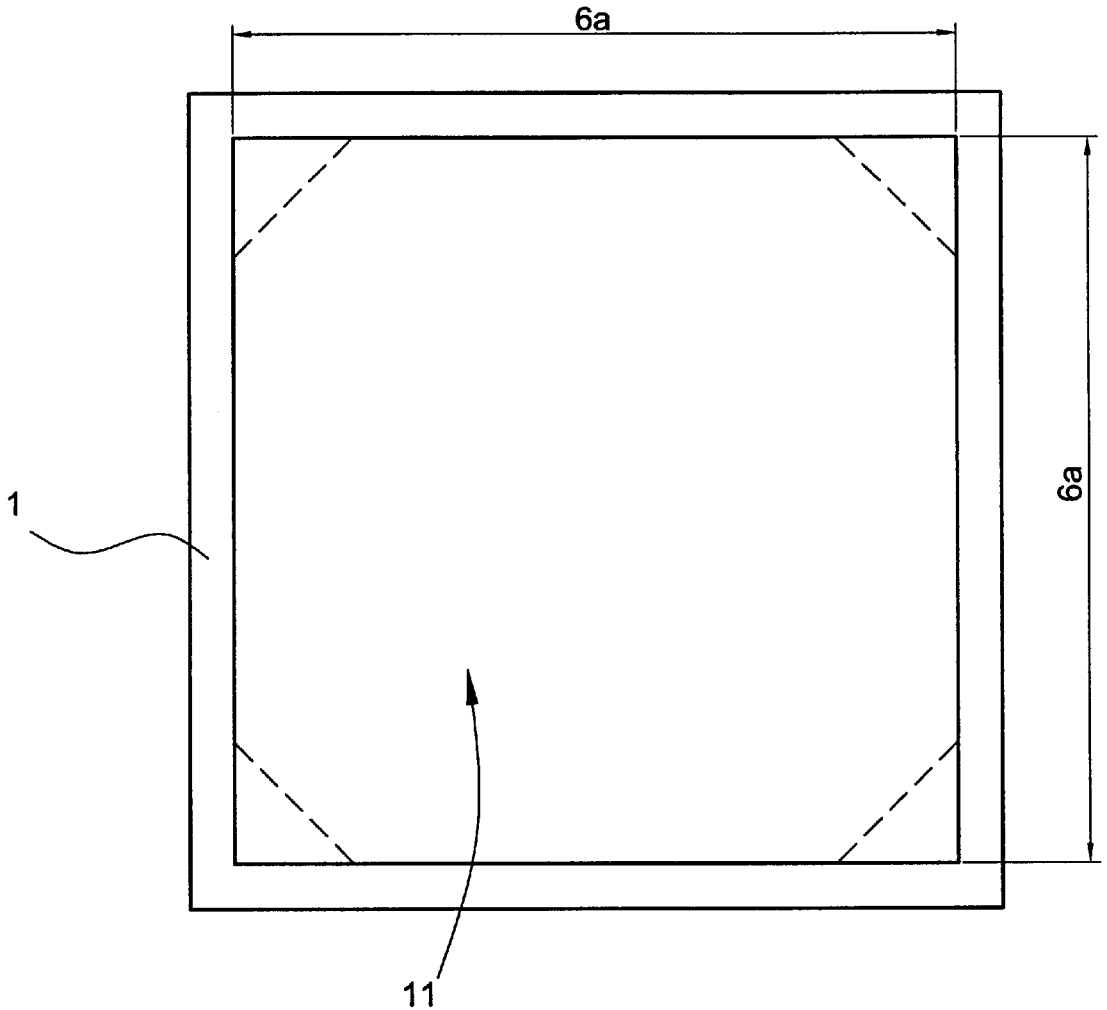
FIG. 1 is a perspective view of a board of the present invention.
Figure 2:
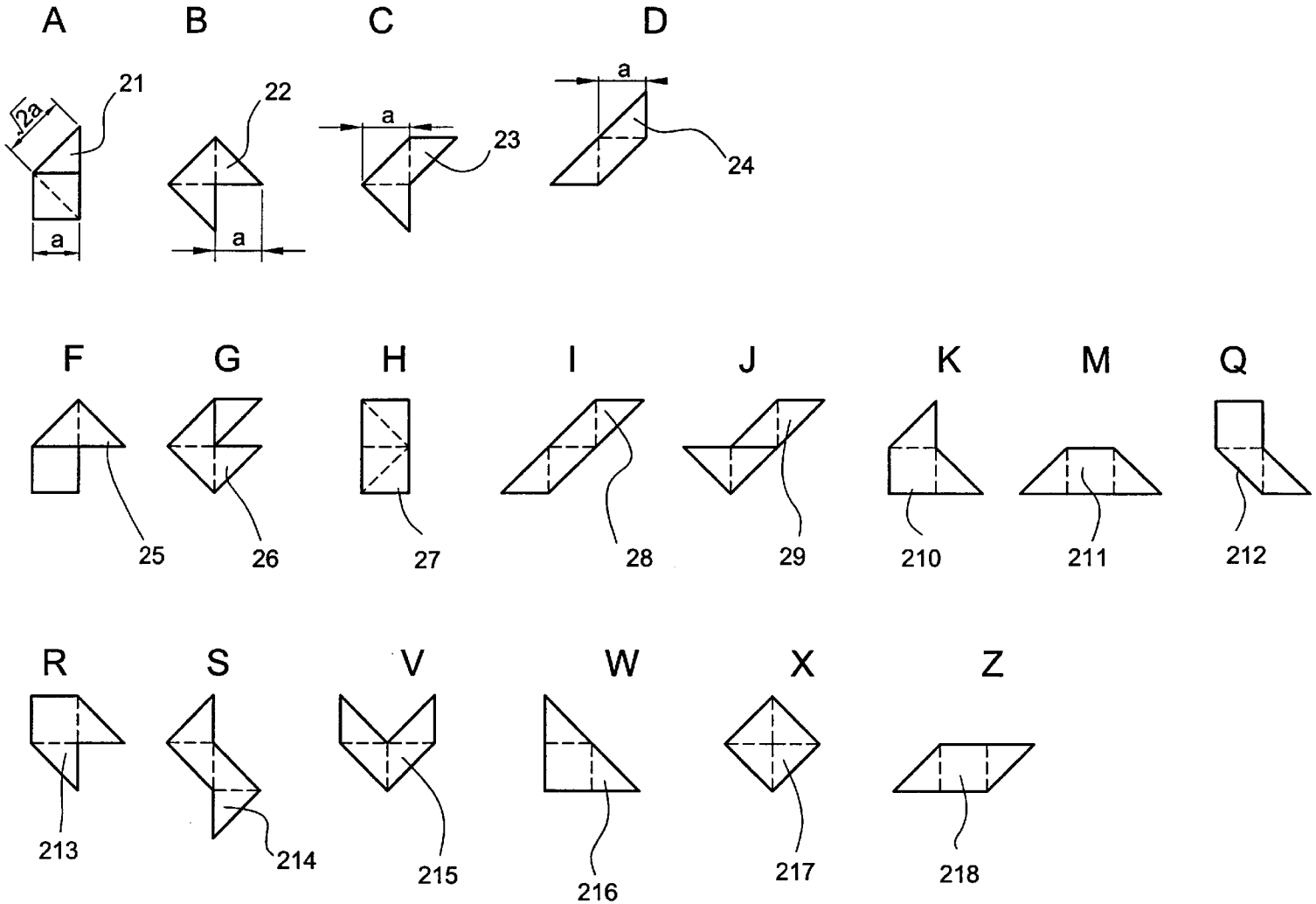
FIG. 2 show an array of different geometric forms created from the eighteen pieces.

Refer to FIG. 1 and FIG. 2, the present invention includes a board 1 and eighteen pieces composed of a plurality of isosceles right triangles. The board 1 is two-sided with a square front face 11 that has the length of each side 6 times of the side (a) of the foregoing isosceles right triangles so as to accommodate the eighteen pieces of puzzles on the front face 11 of the board 1. The eighteen pieces of puzzles are described and noted as following:

A-shaped piece (21) is made of three isosceles right triangles and looks like a square plus a triangle.

B-shaped piece (22) is made of three isosceles right triangles and looks like a square cutting an isosceles right triangle off.

C-shaped piece (23) is made of three isosceles right triangles and looks like a parallelogram plus a triangle.

D-shaped piece (24) is made of three isosceles right triangles and looks like a trapezoid.

F-shaped piece (25) is made of four isosceles right triangles and looks like a bit triangle with a small square underneath.

G-shaped piece (26) is made of four isosceles right triangles and looks like a big triangle with a small parallelogram.

H-shaped piece (27) is made of four isosceles right triangles that form a rectangle.

I-shaped piece (28) is made of four isosceles right triangles that form a thin parallelogram.

J-shaped piece (29) is made of four isosceles right triangles and looks like a high boot.

K-shaped pieces (210) is made of four isosceles right triangles and looks like a chukka boot.

M-shaped piece (211) is made of four isosceles right triangles that form a trapezoid.

Q-shaped piece (212) is made of four isosceles right triangles and looks like square plus a parallelogram.

R-shaped piece (213) is made of four isosceles right triangles and looks like a wide arrow.

S-shaped piece (214) is made of four isosceles right triangles and looks like a rotor.

V-shaped piece (215) is made of four isosceles right triangles and looks like a medal.

W-shaped piece (216) is made of four isosceles right triangles that form a big isosceles right triangle.

X-shaped piece (217) is made of four isosceles right triangles that form a big square.

Z-shaped piece (218) is made of four isosceles right triangles that form a big parallelogram.

Figure 3:
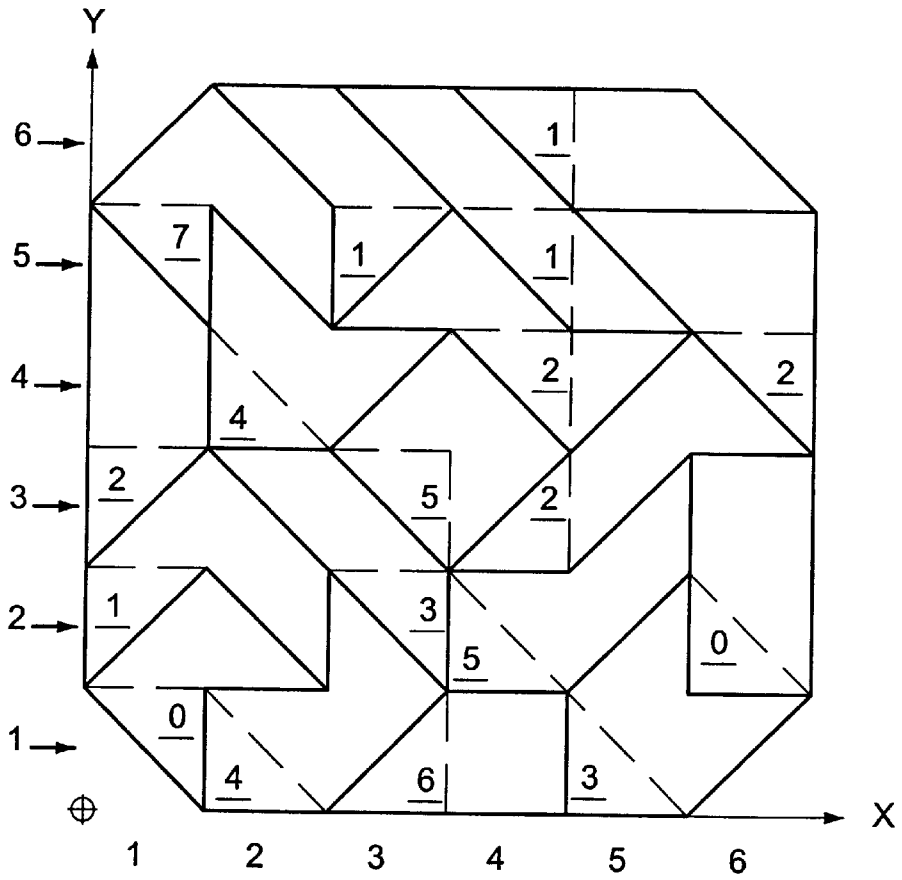
FIG. 3 is a octagon formed by joining eighteen pieces of puzzles (standard combining way) in accordance with the present invention.

In accordance with the structure of each piece mentioned above, the A-shaped piece (21), B-shaped pieces (22), C-shaped piece (23), D-shaped piece (24), F-shaped piece (25), G-shaped piece (26), H-shaped piece (27), I-shaped piece (28), J-shaped piece (29), K-shaped piece (210), M-shaped piece (211), Q-shaped piece (212), R-shaped piece (213), S-shaped piece (214), V-shaped piece (215), W-shaped piece (216), X-shaped piece (217), Z-shaped piece (218) form the octagon diagram shown in FIG. 3. The combination of eighteen pieces is called standard method.

Figure 5:
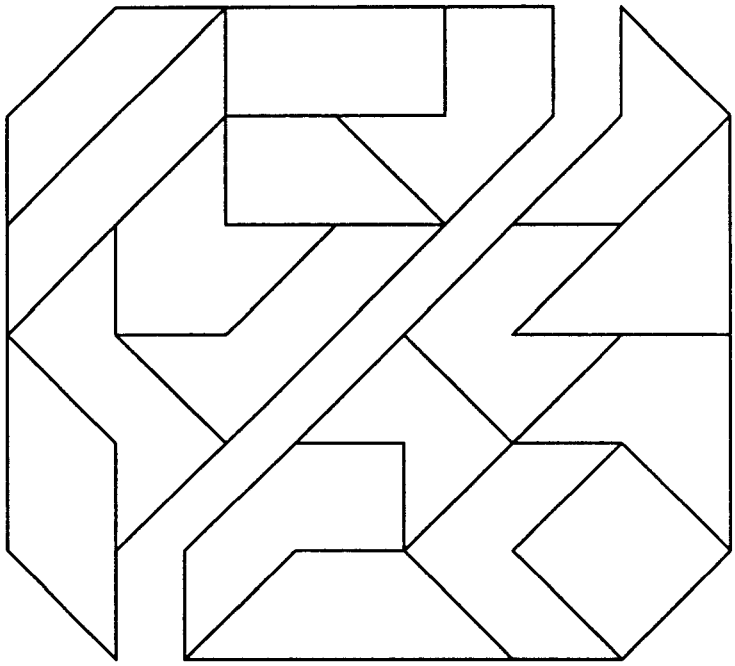
FIG. 5 is another octagon formed by joining eighteen pieces of puzzles (standard combining way) in accordance with the present invention in different arrangement.
Figure 4:
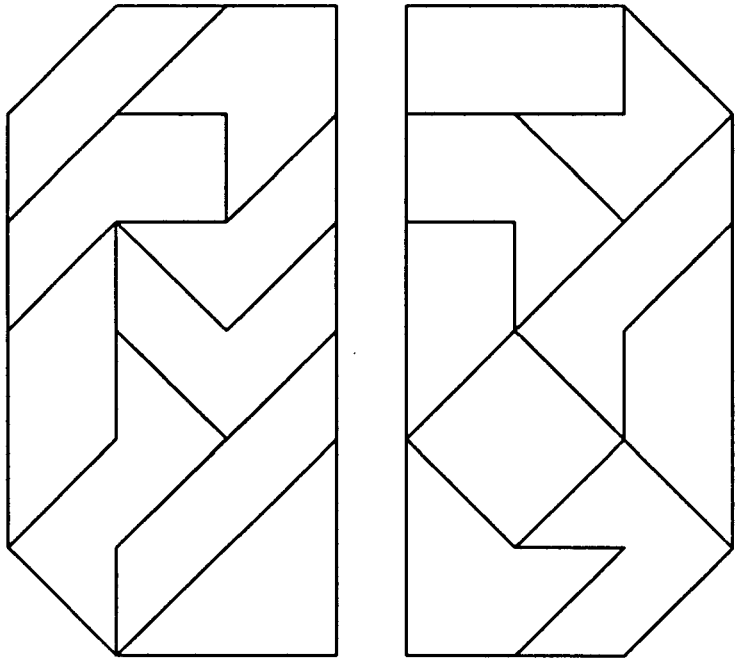
FIG. 4 is another octagon formed by joining eighteen pieces of puzzles (standard combining way) in accordance with the present invention in different arrangement.

With reference to FIG. 4, the combination digram shows two symmetrical hexgons. Or as shown in FIG. 5, two heptagons as image by inversion for each other form a octagon diagram. These are another arrangements of the octagon in accordance with the standard method of the present invention.

Figure 7:
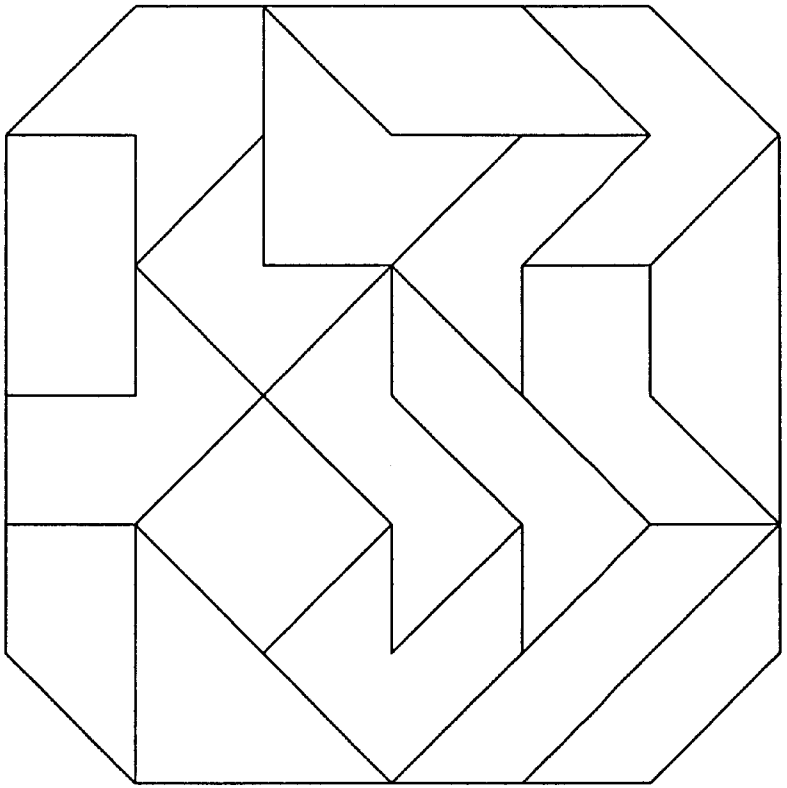
FIG. 7 is another octagon formed by joining eighteen pieces of puzzles (standard combining way) in accordance with the present invention in different arrangement.
Figure 6:
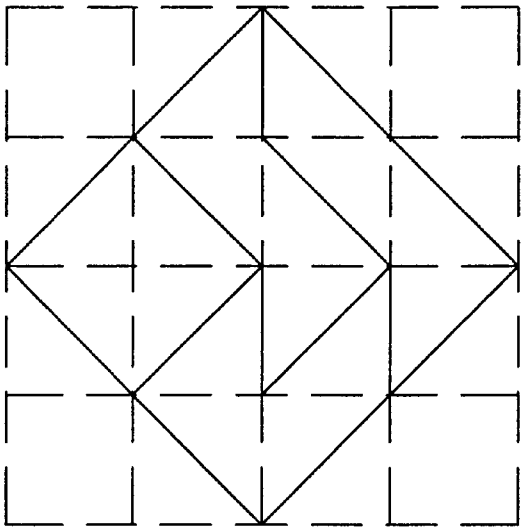
FIG. 6 is a square formed by joining part of eighteen pieces of puzzles during constructing the octagon made of eighteen pieces of puzzles (standard combining way) in accordance with the present invention.

Moreover, part of the eighteen pieces can construct a square at first (see FIG. 6), then adding rest pieces to form an octagon, as shown in FIG. 7. This is another way of arrangement of the present invention which forms a octagon including a small square thereof.

Figure 9:
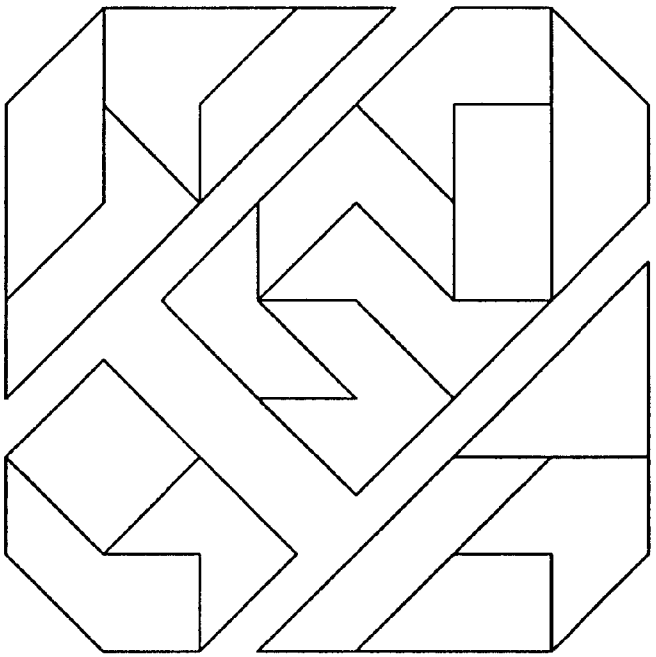
FIG. 9 is another octagon formed by joining eighteen pieces of puzzles (standard combining way) in accordance with the present invention in different arrangement.
Figure 8:
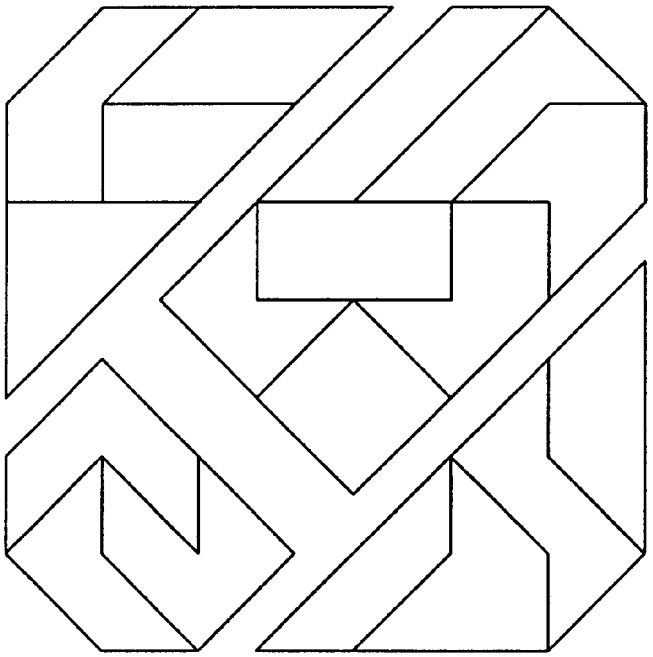
FIG. 8 is another octagon formed by joining eighteen pieces of puzzles (standard combining way) in accordance with the present invention in different arrangement.
Figure 10:
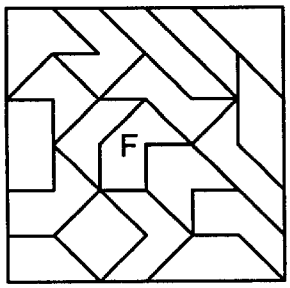
FIG. 10 shows a square formed by joining eighteen pieces of puzzles and a piece of F-shape puzzle in the center (double one combining way) in accordance with the present invention.
Figure 11:
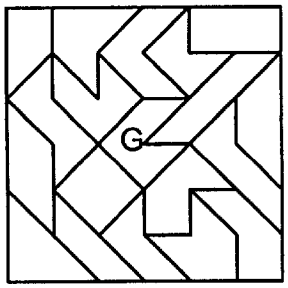
FIG. 11 shows a square formed by joining eighteen pieces of puzzles and a piece of G-shape puzzle in the center (double one combining way) in accordance with the present invention.
Figure 12:
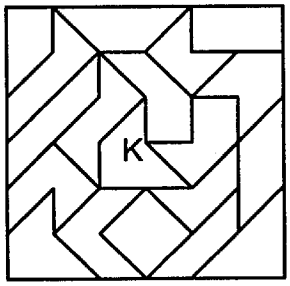
FIG. 12 shows a square formed by joining eighteen pieces of puzzles and a piece of K-shape puzzle in the center (double one combining way) in accordance with the present invention.
Figure 13:
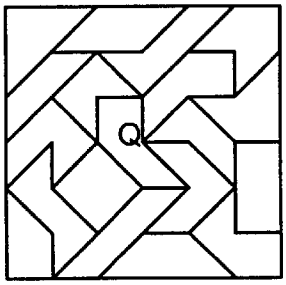
FIG. 13 shows a square formed by joining eighteen pieces of puzzles and a piece of Q-shape puzzle in the center (double one combining way) in accordance with the present invention.
Figure 14:
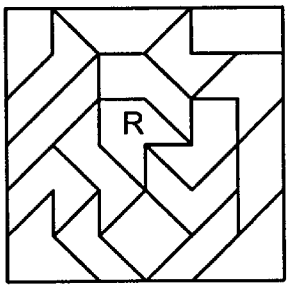
FIG. 14 shows a square formed by joining eighteen pieces of puzzles and piece of R-shape puzzle in the center (double one combining way) in accordance with the present invention.
Figure 15:
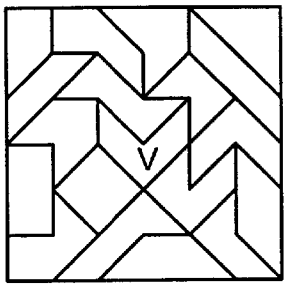
FIG. 15 shows a square formed by joining eighteen pieces of puzzles and a piece of V-shape puzzle in the center (double one combining way) in accordance with the present invention.
Figure 16:
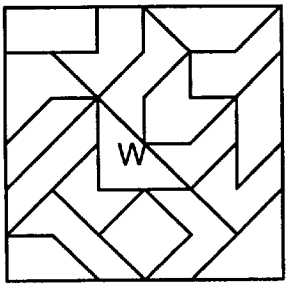
FIG. 16 shows a square formed by joining eighteen pieces of puzzles and a piece of W-shape puzzle in the center (double one combining way) in accordance with the present invention.
Figure 17:
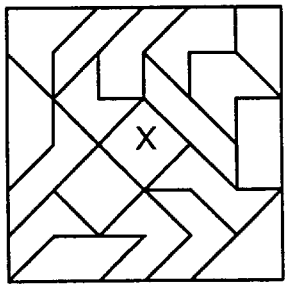
FIG. 17 shows a square formed by joining eighteen pieces of puzzles and a piece of X-shape puzzle in the center (double one combining way) in accordance with the present invention.
Figure 18:
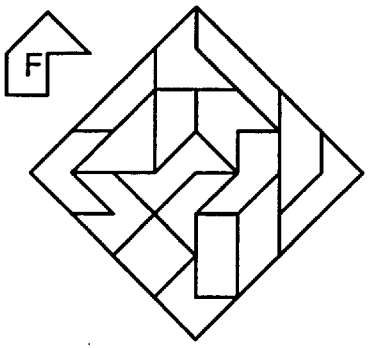
FIG. 18 shows a square formed by joining eighteen pieces of puzzles without a piece of F-shape puzzle (lost one combining way) in accordance with the present invention.
Figure 19:
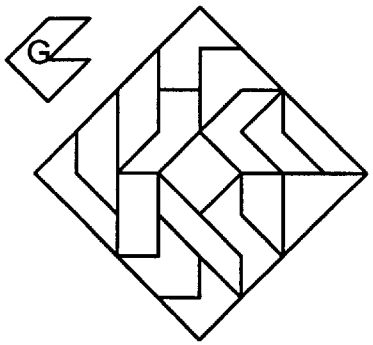
FIG. 19 shows a square formed by joining eighteen pieces of puzzles without a piece of G-shape puzzle (lost one combining way) in accordance with the present invention.
Figure 20:
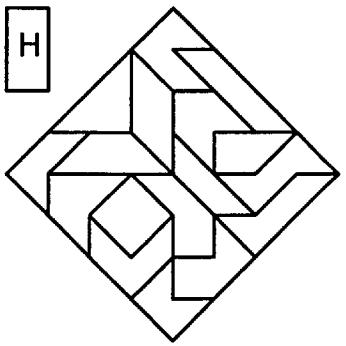
FIG. 20 shows a square formed by joining eighteen pieces of puzzles without a piece of H-shape puzzle (lost one combining way) in accordance with the present invention.
Figure 21:
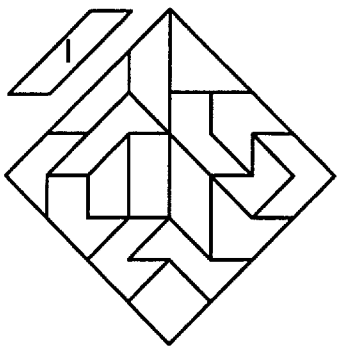
FIG. 21 shows a square formed by joining eighteen pieces of puzzle without a piece of I-shape puzzle (lost one combining way) in accordance with the present invention.
Figure 22:
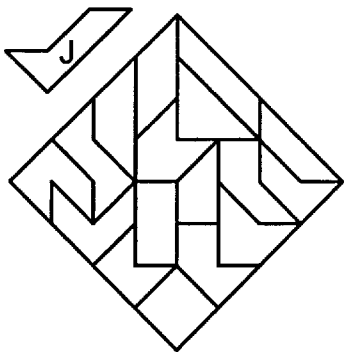
FIG. 22 shows a square formed by joining eighteen pieces of puzzles without a piece of J-shape puzzle (lost one combining way) in accordance with the present invention.
Figure 23:
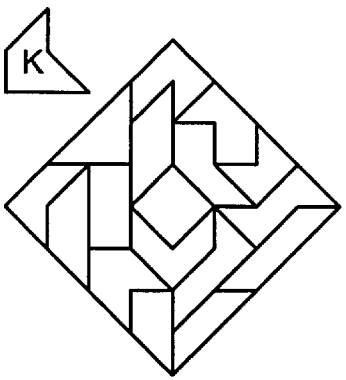
FIG. 23 shows a square formed by joining eighteen pieces of puzzles without a piece of K-shape puzzle (lost one combining way) in accordance with the present invention.
Figure 24:
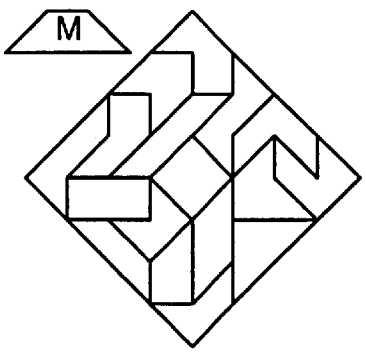
FIG. 24 shows a square formed by joining eighteen pieces of puzzles without a piece of M-shape puzzle (lost one combining way) in accordance with the present invention.
Figure 25:
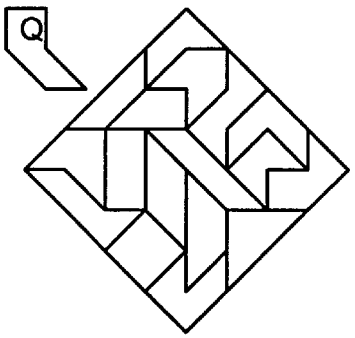
FIG. 25 shows a square formed by joining eighteen pieces of puzzles without a piece of Q-shape puzzle (lost one combining way) in accordance with the present invention.
Figure 26:
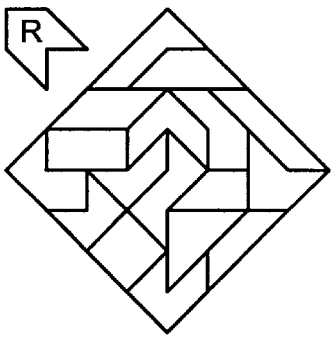
FIG. 26 shows a square formed by joining eighteen pieces of puzzles without a piece of R-shape puzzle (lost one combining way) in accordance with the present invention.
Figure 27:
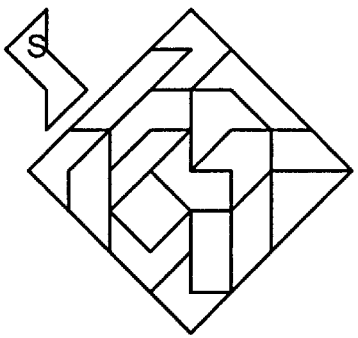
FIG. 27 shows a square formed by joining eighteen pieces of puzzles without a piece of S-shape puzzle (lost one combining way) in accordance with the present invention.
Figure 28:
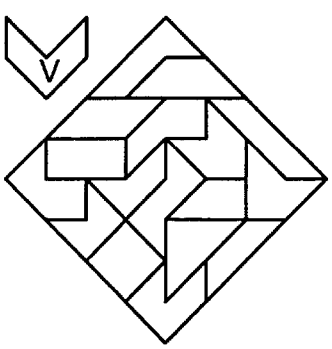
FIG. 28 shows a square formed by joining eighteen pieces of puzzles without a piece of V-shape puzzle (lost one combining way) in accordance with the present invention.
Figure 29:
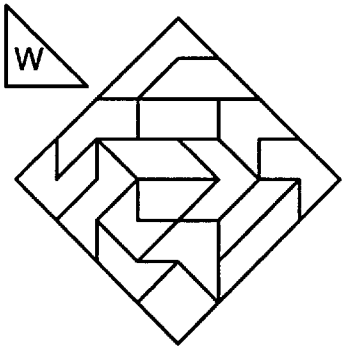
FIG. 29 shows a square formed by joining eighteen pieces of puzzles without a piece of W-shape puzzle (lost one combining way) in accordance with the present invention.
Figure 30:
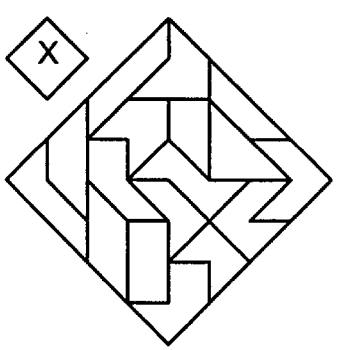
FIG. 30 shows a square formed by joining eighteen pieces of puzzles without a piece of X-shape puzzle (lost one combining way) in accordance with the present invention.
Figure 31:
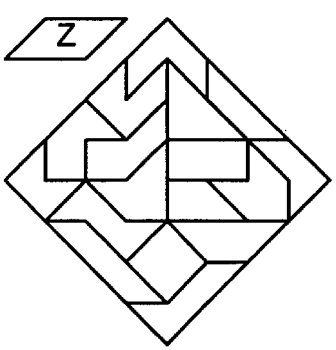
FIG. 31 shows a square by joining eighteen pieces of puzzles without a piece of Z-shape puzzle (lost one combining way) in accordance with the present invention.

FIG. 8 and FIG. 9 show that the octagon is formed by a pair of symmetrical trapezoids, a wide hexagon, and a high hexagon. Both of these two arrangements are belonging to another family of solutions. The foregoing embodiments are only for reference, practical solutions can be grouped into a number of families that provides an excellent source of thinking and entertainment for players.

Furthermore, the eighteen puzzles plus any one piece (tetratan) thereof, such as F-shaped piece (25), G-shaped piece (26), K-shaped piece (210), Q-shaped piece (212), R-shaped piece (213), V-shaped piece (215), W-shaped piece (216), X-shaped piece (217), can build a number of large square diagram as show from FIG. 10 to FIG. 17. This way of arrangement is called a double one (in center) combination.

On the contrary, the eighteen puzzles cut any one piece thereof, such as F-shaped piece (25), G-shaped piece (26), H-shaped piece (27), I-shaped piece (28), J-shaped piece (29), K-shaped piece (210), M-shaped piece (211), Q-shaped piece (212), R-shaped piece (213), S-shaped piece (214), V-shaped piece (215), W-shaped piece (216), X-shaped piece (217), Z-shaped piece (218) construct a smaller square diagram as shown from FIG. 18 to FIG. 31. This way of arrangement is called a lost one (tetratan) combination.

Back to FIG. 1, this shows the square front face 11 of the board 1 is used for accommodating standard combination with eighteen pieces or double one combination with nineteen pieces. The length of one side of the front face 11 equals to 6 times of that one side (a) of the above-mentioned isosceles right triangles.

Figure 32:
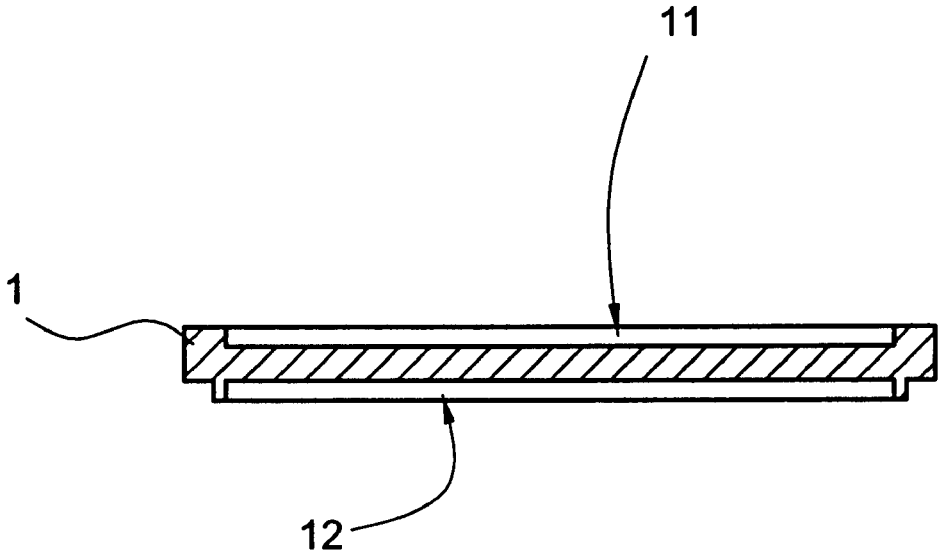
FIG. 32 is a cross-sectional view of the board in accordance with the present invention.
Figure 33:
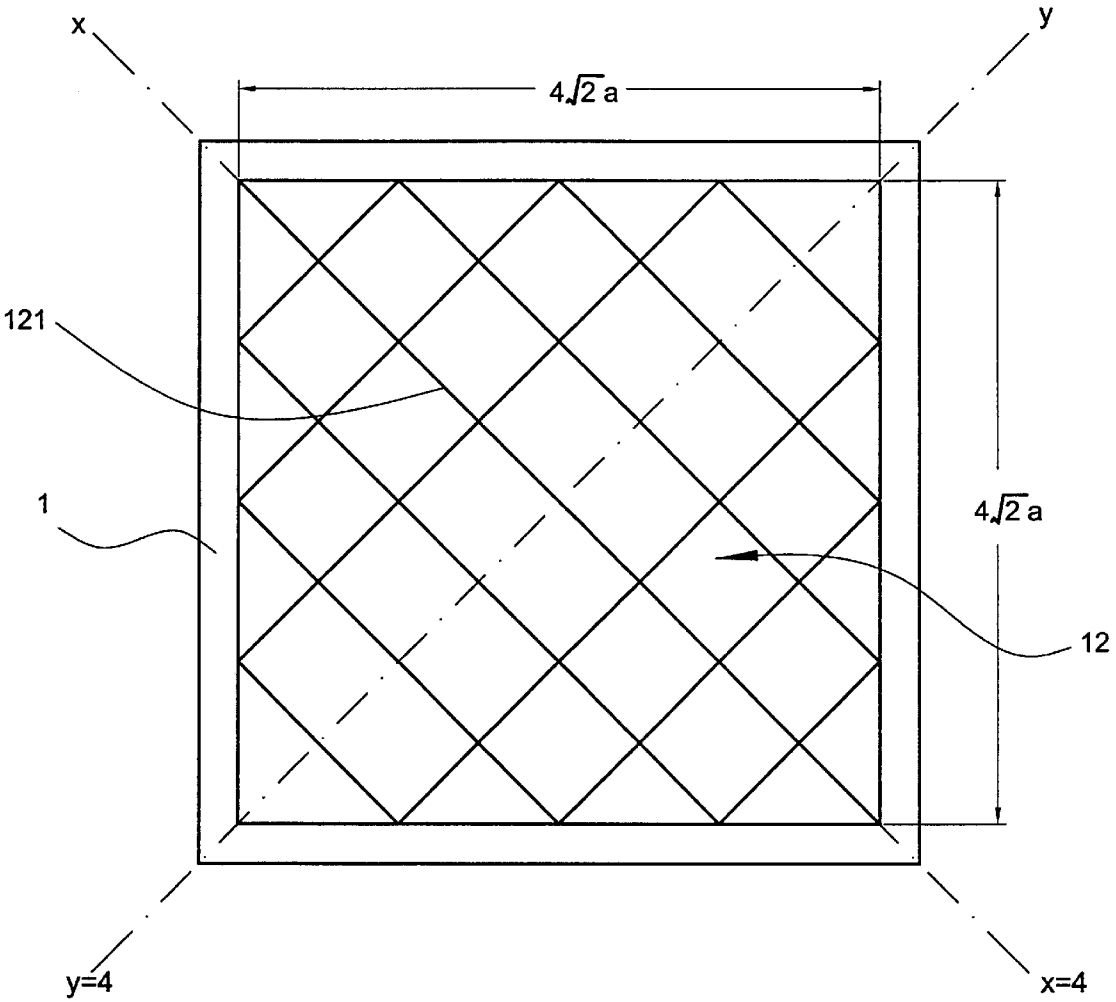
FIG. 33 is the rear face of the board of the present invention.

The rear face 12 of the board 1, shown in FIG. 32 and FIG. 33, is for arranging lost one combination with seventeen pieces. The shape of the rear face 12 is also square whose length of one side is 4 times of that of the hypotenuse of the above-mentioned isosceles right triangles.

Figure 34:
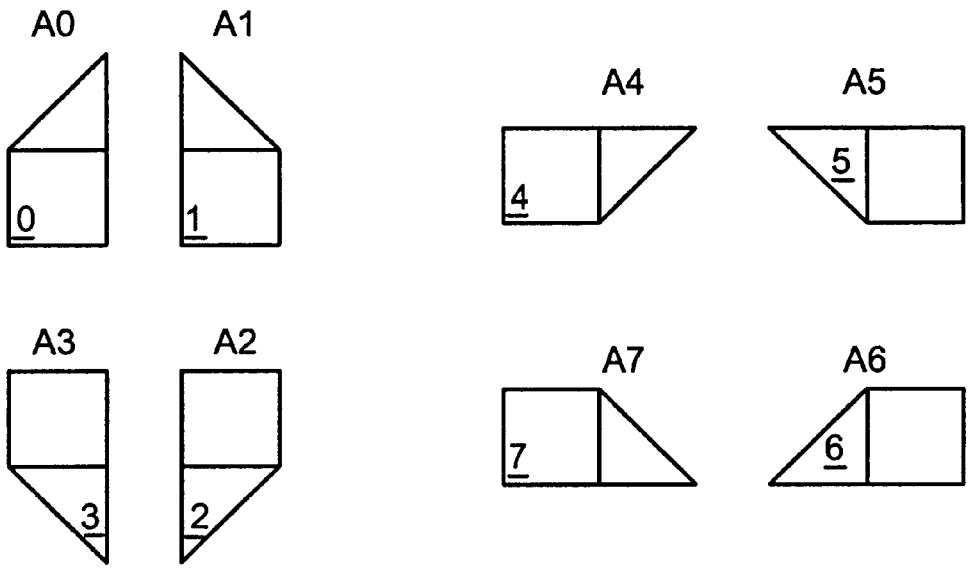
FIG. 34 is different rotational forms of A-shaped piece with ways of labeling in accordance with the present invention.

FIG. 34 shows the notation for different positions of A-shaped piece (21). By using the system of right-angled coordinates, the first shape A0 (label 0 on the left-down site) on the second quadrant, the symmetrical figures on the first, third and fourth quadrants are A1, A2, and A3. When A1 is rotated 90 degree to the direction of three o'clock, the figure is named A4. The serial number of the symmetrical figures corresponding to A4 on the first, third and fourth quadrants are A5, A7, A6. The serial number is labeled on the down-left corner of the diagram. The point on the down-left of the board 1 as the origin of coordinates, the points on the axis of abscissa are named X1, X2, X3, X4, X5, X6 in a certain distance that equals to the length of one side of the foregoing isosceles right triangle. The points on the axis of ordinates moving up is named Y1, Y2, Y3, Y4, Y5, Y6. The notation of different positions of each pieces and coordinates are for easy memorizing and describing the solutions of puzzles. The record of noting solutions is from the origin with X increasing to the right, and then with Y increasing going up. Refer to FIG. 3, the record of this diagram is B0F4A6R3V1D3Q5H0M2X5J2K4S2W2G7C1I1Z1. The alphabetical and numeral ways of recording solutions is convenient for remote communication of players without the need of drawing figures.

Figure 35:
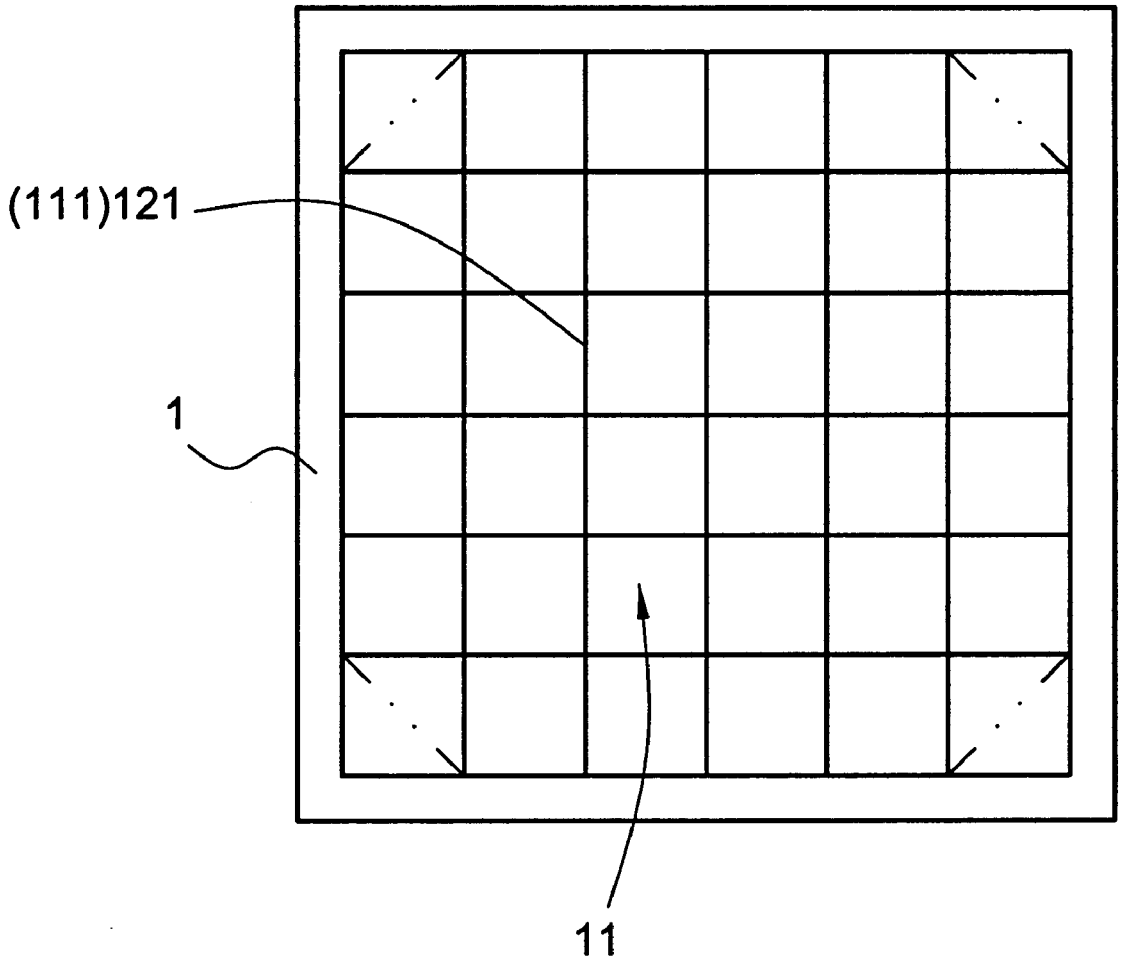
FIG. 35 is a perspective of the board with a quadrilled line.
Figure 36:
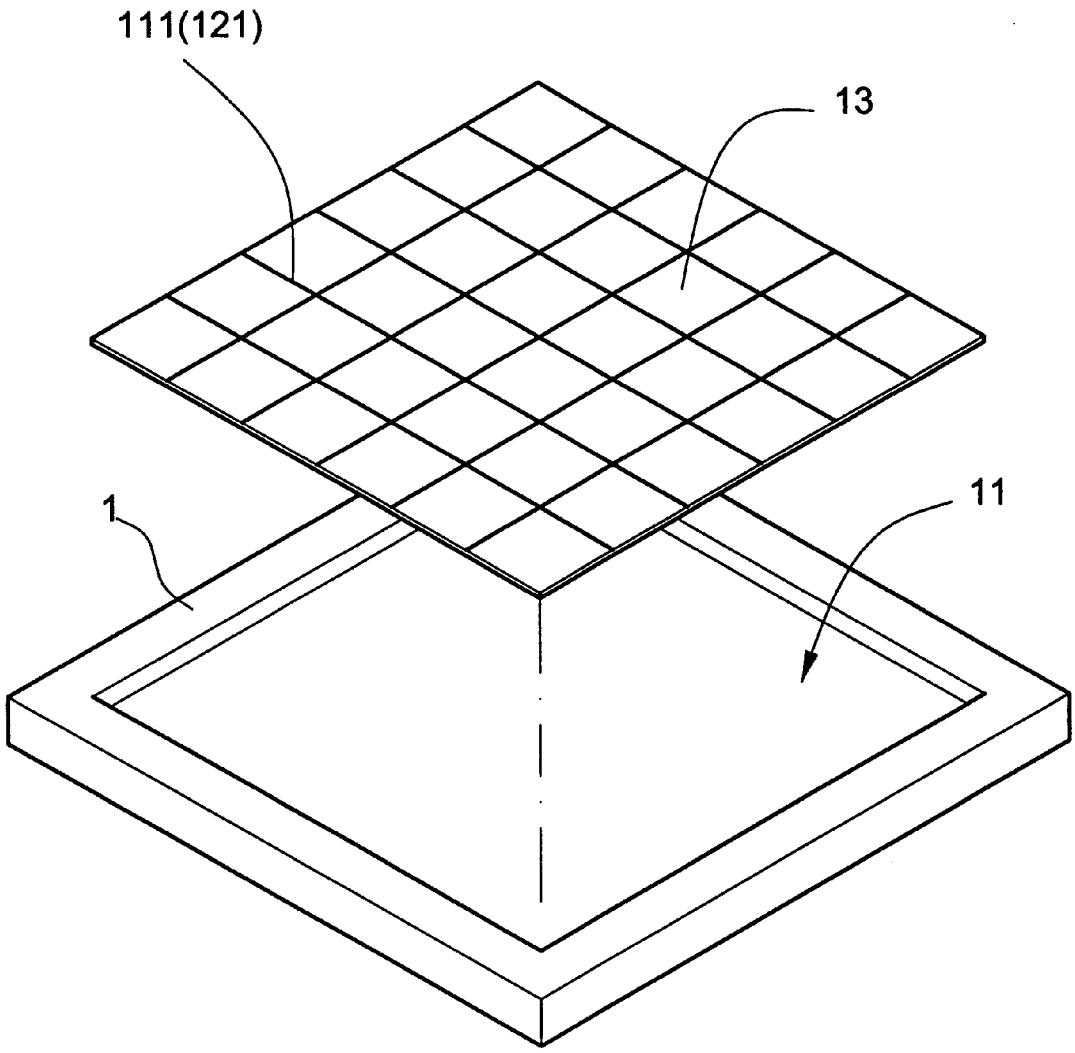
FIG. 36 is a explosive view of the board with a quadrilled line.

Referring to FIG. 35, a plurality of grids 111, 121 are arranged on the front face 11 and rear face 12 of the board 1 respectively for the convenience of easy arrangements. FIG. 36 shows the front face 11 or rear face 12 of the board 1 is covered a piece of transparent film 13 with grids thereof.

Figure 37:
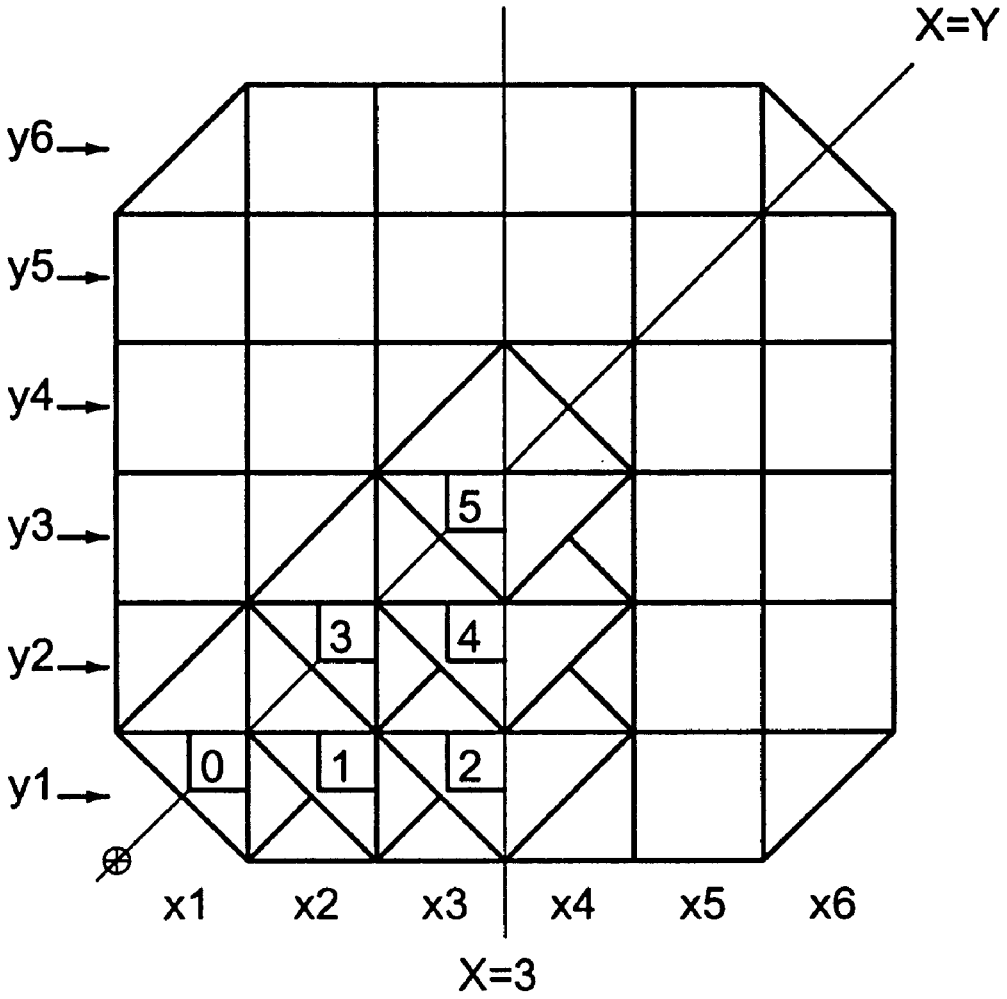
FIG. 37 show the possible locations of X-shaped piece in standard combination of the present invention.
Figure 38:
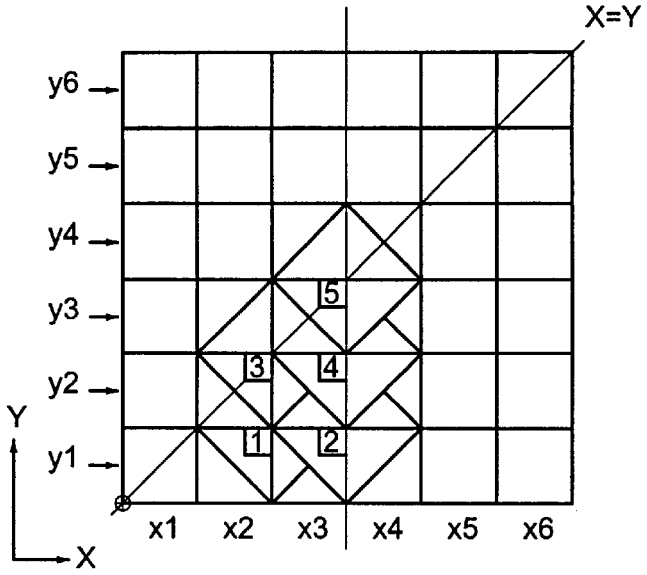
FIG. 38 show the possible locations of X-shaped piece in double one combination of the present invention.
Figure 39:
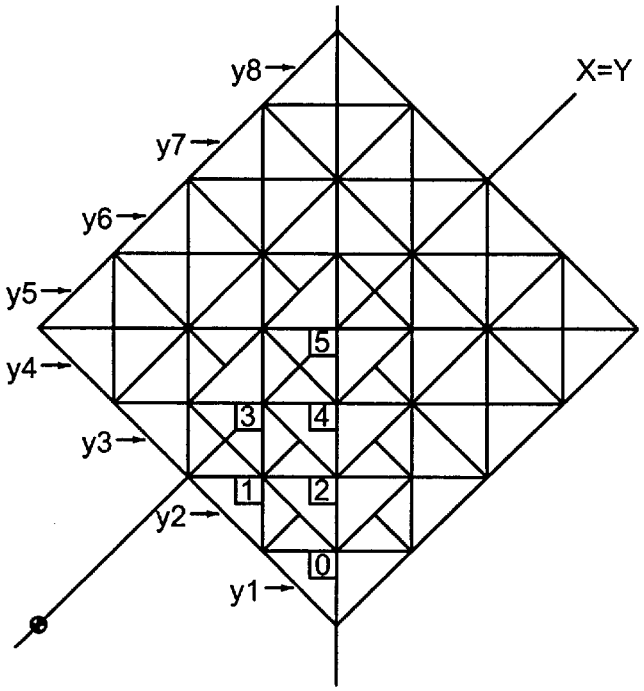
FIG. 39 show the possible locations of X-shaped piece in lost one combination of the present invention.

Due to the symmetry of X-shaped piece, the position of X-shaped piece is limited in certain area in order to avoid the overlapping solutions. Refer to FIG. 37, FIG. 38, and FIG. 39, each shows the possible positions and its serial numbers of X-shaped piece in different combinations.

Figure 40:
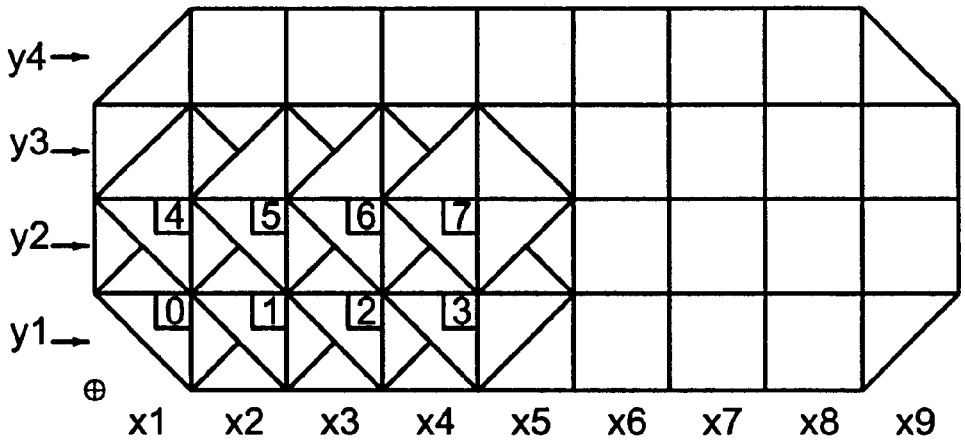
FIG. 40 is a modified combination form of the present invention.
Figure 41:
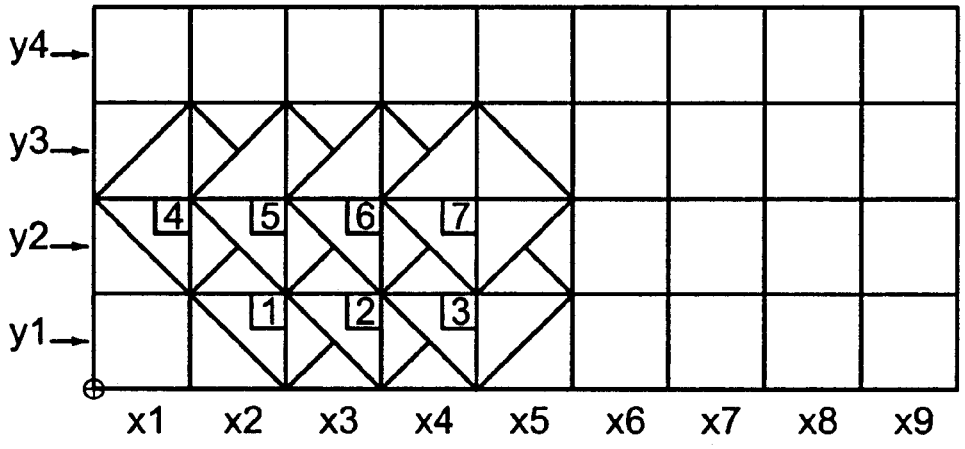
FIG. 41 is another modified combination form of the present invention.

FIG. 40 and FIG. 41 show another ways of combination, a symmetrical octagon and a rectangular. The possible positions and its serial number of X-shaped piece are also shown in figures.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. An eighteen-piece pro-tangram tiling game primarily comprising a board with a face, and eighteen pieces of puzzles constituted by three or four isosceles right triangles, wherein said face on said board is a square that the length of each side thereof is 6 times of that of one side of said isosceles right triangles so as to accommodate said eighteen pieces of puzzles or eighteen pieces plus any one piece formed by four said isosceles right triangles;

said eighteen pieces of puzzles are described and noted as following:

A-shaped piece is made of three isosceles right triangles and looks like a square with a triangle above;

B-shaped piece is made of three isosceles right triangles and looks like a square cutting an isosceles right triangle off;

C-shaped piece is made of three isosceles right triangles and looks like a parallelogram with a triangle thereunder;

D-shaped piece is made of three isosceles right triangles and looks like a trapezoid;

F-shaped piece is made of four isosceles right triangles and looks like a big triangle with a small square underneath;

G-shaped piece is made of four isosceles right triangles and looks like a big triangle with a small parallelogram;

H-shaped piece is made of four isosceles right triangles that form a rectangle;

I-shaped piece is made of four isosceles right triangles that form a thin parallelogram;

J-shaped piece is made of four isosceles right triangles and looks like a high boot;

K-shaped piece is made of four isosceles right triangles and looks like a chukka boot;

M-shaped piece is made of four isosceles right triangles that form a trapezoid;

Q-shaped piece is made of four isosceles right triangles and looks like square with a parallelogram underneath;

R-shaped piece is made of four isosceles triangles and looks like a wide arrow;

S-shaped piece is made of four isosceles right triangles and looks like a rotor;

V-shaped piece is made of four isosceles right triangles and looks like a medal;

W-shaped piece is made of four isosceles right triangles that form a big isosceles right triangle;

X-shaped piece is made of four isosceles right triangles that form a big square;

Z-shaped piece is made of four isosceles right triangles that form a big parallelogram.

2. An eighteen-piece pro-tangram tiling game as claimed in claim 1, wherein another face, whose shape is square and the length of each side thereof is 4 times of that of the hypotenuse of said isosceles right triangles, can be mounted on the rear side of said board for accommodating seventeen pieces of said puzzles, eighteen pieces without any one piece formed by four said isosceles right triangles.

3. An eighteen-piece pro-tangram tiling game as claimed in claim 1, wherein a plurality of grids are arranged on said face of said board.

4. An eighteen-piece pro-tangram tiling game as claimed in claim 1, wherein a piece of transparent film with grids is arranged on said face of said board.

5. An eighteen-piece pro-tangram tiling game as claimed in claim 1, wherein each piece of said eighteen pieces of puzzles has two sides and can be rotated 90 degrees 4 times thus having 8 positions, with serial number from 0 to 7 is labeled on the down-left corner thereof; therefore, the solutions of said eighteen puzzles is recorded by alphabetical and numeral ways from down-left corner of said board moving right and then moving up for remote communication of players without the need of drawing figures.

* * * * *